US006185907B1

(12) United States Patent
Malin et al.

(10) Patent No.: US 6,185,907 B1
(45) Date of Patent: Feb. 13, 2001

(54) HORIZONTAL FORM-FILL-AND-SEAL MACHINE WITH ZIPPER ATTACHMENT

(75) Inventors: Art Malin, Northbrook, IL (US); Joel L. Johnson, Stockbridge, GA (US)

(73) Assignee: Illinois Tool Works Inc., Glenview, IL (US)

( * ) Notice: Under 35 U.S.C. 154(b), the term of this patent shall be extended for 0 days.

(21) Appl. No.: 09/014,906

(22) Filed: Jan. 28, 1998

(51) Int. Cl.[7] ..... B65B 9/08

(52) U.S. Cl. ..... 53/412; 53/55; 53/133.4; 53/139.2; 493/34

(58) Field of Search ..... 53/139.2, 133.4, 53/52, 55, 58, 412; 493/3, 34

(56) References Cited

U.S. PATENT DOCUMENTS

| | | | | |
|---|---|---|---|---|
| 3,274,746 | | 9/1966 | James et al. | 53/22 |
| 4,589,145 | | 5/1986 | Van Erden et al. | 383/5 |
| 4,724,429 | * | 2/1988 | Millen et al. | 340/679 |
| 4,812,074 | * | 3/1989 | Ausnit et al. | 493/213 |
| 4,876,842 | * | 10/1989 | Ausnit | 53/410 |
| 4,941,307 | * | 7/1990 | Wojcik | 53/412 |
| 4,945,714 | * | 8/1990 | Bodolay et al. | 53/568 |
| 5,092,831 | | 3/1992 | James et al. | 493/394 |
| 5,179,816 | * | 1/1993 | Wojnicki | 53/133.4 |
| 5,247,781 | * | 9/1993 | Runge | 53/412 |

* cited by examiner

*Primary Examiner*—Joseph J. Hail, III
(74) *Attorney, Agent, or Firm*—Pitney, Hardin, Kipp & Szuch LLP

(57) ABSTRACT

In a horizontal form-fill-and-seal (FFS) machine, a continuous length of packaging film is folded lengthwise over the consumer products to be packaged. The lateral edges of the packaging film are separately and independently aligned with one another by edge sensing and control devices. A zipper is fed between the aligned lateral edges of the packaging film. The lateral edges are sealed to one another, and the zipper sealed to the folded packaging film, by a pair of sealing sections, each of which includes a pair of parallel sealing devices. Side seals are produced by conventional means, which also separate completed packages from one another.

9 Claims, 4 Drawing Sheets

HORIZONTAL FORM-FILL-AND-SEAL MACHINE WITH ZIPPER ATTACHMENT

FIELD OF THE INVENTION

The present invention relates to reclosable plastic bags of the type in which perishable food products and other goods are packaged for sale to consumers in retail outlets. More specifically, the present invention relates to reclosable plastic bags which are concurrently manufactured and filled with a consumer product on a horizontal form-fill-and-seal (FFS) machine, wherein a plastic interlocking zipper for each bag is disposed longitudinally relative to the direction of motion of the thermoplastic sheet material used to form the reclosable bags on the FFS machine.

DESCRIPTION OF THE PRIOR ART

The present invention relates to improvements in the package-making art and may be practiced in the manufacture of thermoplastic bags and packages of the kind that may be used for various consumer products, but which are particularly useful for food products which must be kept in moisture- and air-tight packages, free from leakage until initially opened for access to the product contents, which packages are then reclosable by zipper means to protect any remainder of the product therein.

The indicated art is fairly well-developed, but nevertheless remains open to improvements contributing to increased efficiency and cost effectiveness.

The present invention relates more particularly to the production of reclosable plastic bags which are concurrently manufactured and filled with a consumer product on a horizontal FFS machine. In this regard, U.S. Pat. No. 4,589,145 shows a method of and apparatus for packaging a block-shaped product, such as cheese, into a wrapped envelope package, with material especially adapted for said packaging, wherein a bottom face of the product article is engaged on a panel area of the wrapper sheet, which sheet has extended portions that are wrapped about the article and sealed across the top face of the article. One of the portions of the wrapper sheet has a reclosable zipper and a web portion alongside the zipper which is adapted to be severed or ruptured to provide a mouth opening for access to the article within the package, the mouth opening being reclosable by the enclosed zipper. The zipper may be provided with structure to prevent its being pulled open during the wrapping and sealing of the wrapper about the article. The web portion may have guidance for severing or rupturing the same when access into the package is desired.

In U.S. Pat. No. 4,876,842, another method of and apparatus for packaging product masses in an FFS machine, wherein a continuous length of packaging film is joined in running relation by a continuous length of separately formed plastic reclosable fastener assembly having interlock profile strips spot-sealed together at package-length intervals, are shown. The co-running fastener strip assembly and the packaging film are oriented so that the spot seals of the strip are located in alignment with the spaces between the product masses on the film to ensure that the fastener strip assembly will be cross-sealed at the spot seals when the film is cross sealed between the product masses to provide individual packages. The orienting may be effected by an indexing arrangement including sensor response to index marks on the film and the fastener assembly.

The present method and apparatus are improvements over those disclosed in these prior-art U.S. patents.

SUMMARY OF THE INVENTION

Accordingly, the present invention is a horizontal form-fill--and-seal (FFS) machine for packaging consumer products. The horizontal FFS machine comprises means, such as a supply roll, for providing a continuous length of packaging film having two lateral edges for use in packaging the products, and means for placing the consumer products to be packaged at intervals along one half of the continuous length of packaging film.

The horizontal FFS machine also includes means for folding the continuous length of packaging film continuously down the center thereof and over upon the consumer products, and means for aligning the lateral edges of the folded continuous length of packaging film with one another. Means for feeding a zipper between the aligned lateral edges of the packaging film are also included.

A zipper sealing section includes means for sealing the aligned lateral edges of the continuous length of packaging film to one another, and means for sealing the zipper within the folded packaging film.

Means for sealing the folded packaging film at intervals between the consumer products to create individual packages, and for separating the individual packages from one another, are also a part of the machine.

The present invention will now be described in more complete detail with frequent reference being made to the figures identified below.

DETAILED DESCRIPTION OF THE PREFERRED EMBODIMENT

Figure 1:
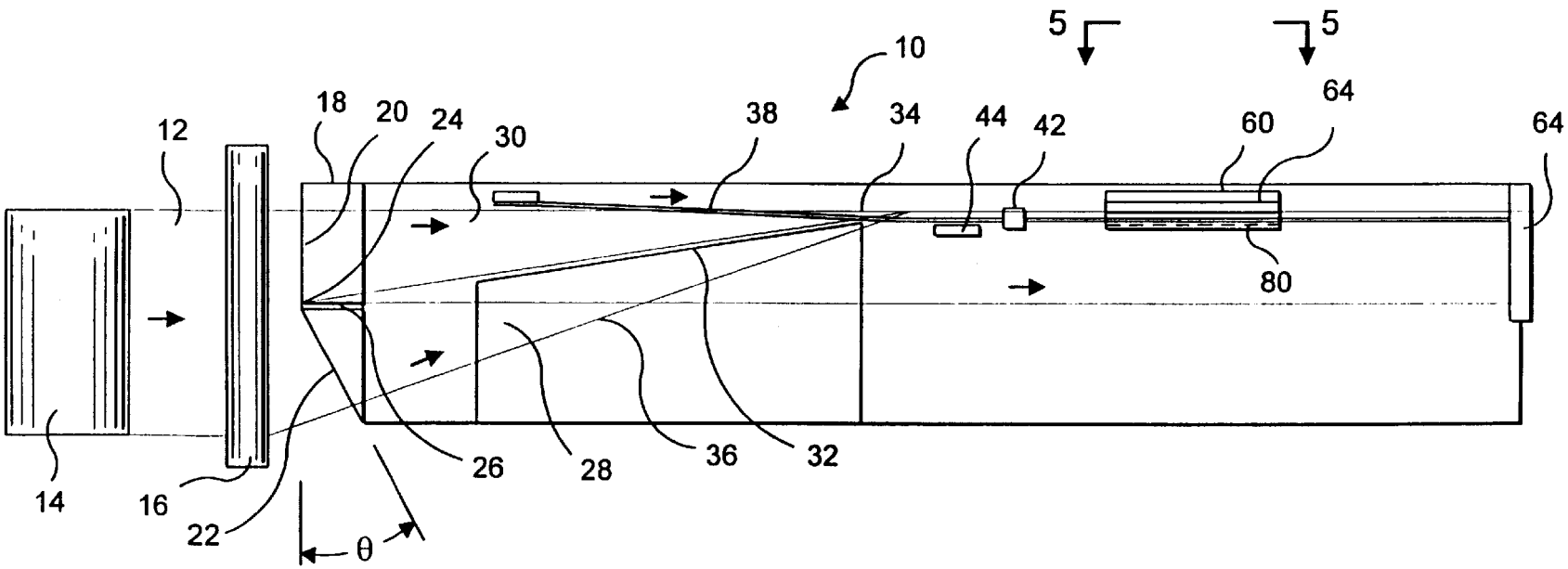
FIG. 1 is a top schematic plan view of the horizontal FFS machine of the present invention.
Figure 2:
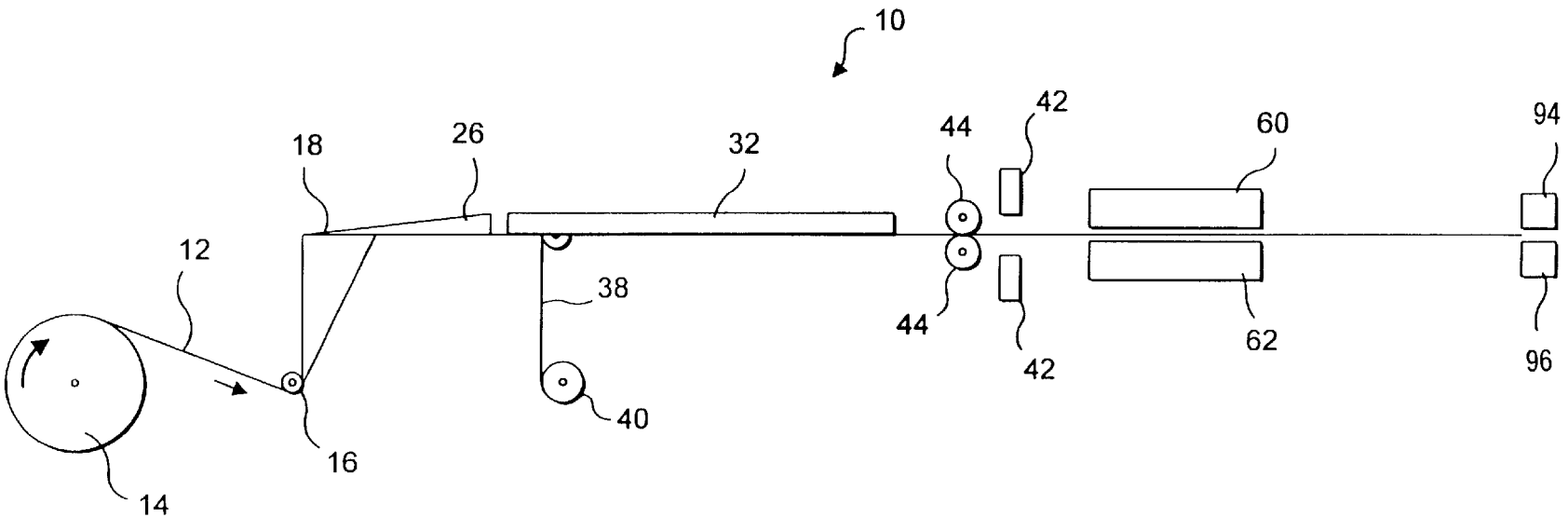
FIG. 2 is a side schematic plan view of the machine.

Referring to FIGS. 1 and 2, which are top and side schematic plan views, respectively, of a horizontal FFS machine 10, a continuous length of packaging film 12, which may comprise polyethylene, is dispensed from a supply roll 14 downward under a guide roll 16 and upward toward a fold-forming member 18.

The fold-forming member 18 includes a first fold-forming edge 20, which is in a direction transverse to the running direction of the packaging film 12, and a second fold-forming edge 22, which makes an oblique angle, $\theta$, between 15° and 30° with respect the direction of the first fold-forming edge 20. Angle $\theta$ is between 15° and 30° to properly control the lateral movement of the film 12 and to minimize the length of the machine 10. The apex 24 formed where the first fold-forming edge 20 meets the second fold-forming edge 22 coincides, more or less, with the center of the packaging film 12, which is continuously folded lengthwise down the middle by the horizontal FFS machine 10. Passage of the packaging film 12 over the apex 24 begins the folding process.

Disposed on the fold-forming member 18 in a direction perpendicular thereto is a wedge-shaped member 26. The wedge-shaped member 26 essentially raises the portion 28 of the packaging film 12 being folded over upward relative to the portion 30 lying flat on the horizontal FFS machine 10.

This is done so that a consumer product to be packaged may be placed on the portion 30 on or near the fold-forming member 18, and eventually be covered by the portion 28 being folded over.

A folding guide 32 is disposed downstream from the fold-forming member 18 and at an oblique angle relative to the running direction of the packaging film 12. The folding guide 32 continuously folds portion 28 of the packaging film 12 over onto portion 30, so that, ultimately, the two lateral edges 34,36 of the packaging film 12 may align with one another, and the packaging film 12 itself may be C-folded continuously in a lengthwise direction.

A zipper 38, comprising a male zipper profile interlocked with a female zipper profile and of a variety well-known to those of ordinary skill in the art, is continuously fed and guided between the two overlapped lateral edges 34,36 of the packaging film 12 from a supply reel 40.

Downstream from the point where the two lateral edges 34,36 first overlap one another, are two edge sensing and control devices. In a preferred embodiment, each edge sensing and control device comprises a photo cell 42 and a steerable guide wheel 44, one edge sensing and control device being provided each of the two lateral edges 34,36. The photo cells 42 accurately sense the locations of the two lateral edges 34,36, and, if there is any departure from the desired location of either of the two lateral edges, signal their respective steerable guide wheels 44 to correct the location.

Figure 4:
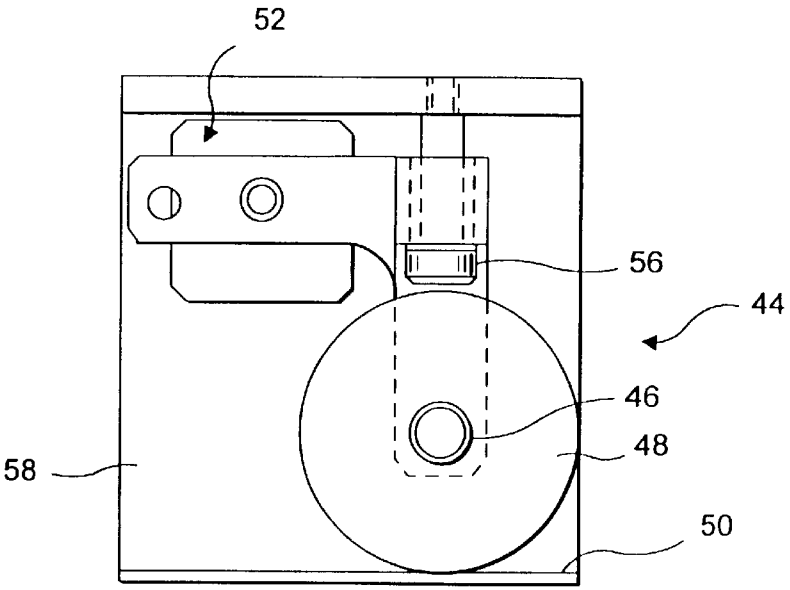
FIG. 4 is a side view of the wheel.
Figure 3:
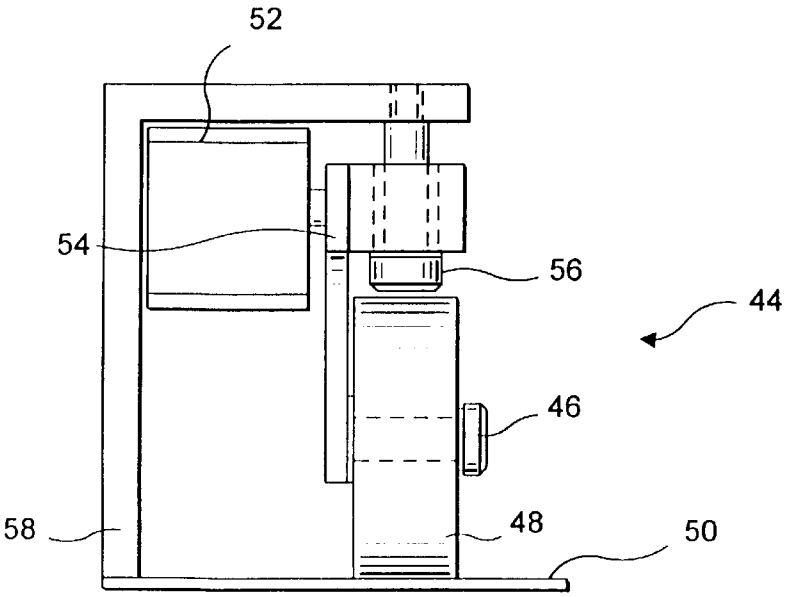
FIG. 3 is a front view of a steerable guide wheel of the horizontal FFS machine.

FIGS. 3 and 4 are front and side views, respectively, of a steerable guide wheel 44. Wheel 44 rotates about a horizontal axis 46, as packaging film 12, clamped between tire 48 and surface 50, moves downstream on the horizontal FFS machine 10. When either of photo cells 42 senses a discrepancy in the desired location of one of the two lateral edges 34,36, cylinder 52, acting upon arm 54, turns the wheel 44 about a vertical axis to move the lateral edge 34,36 in question toward or away from upright member 58.

Figure 5:
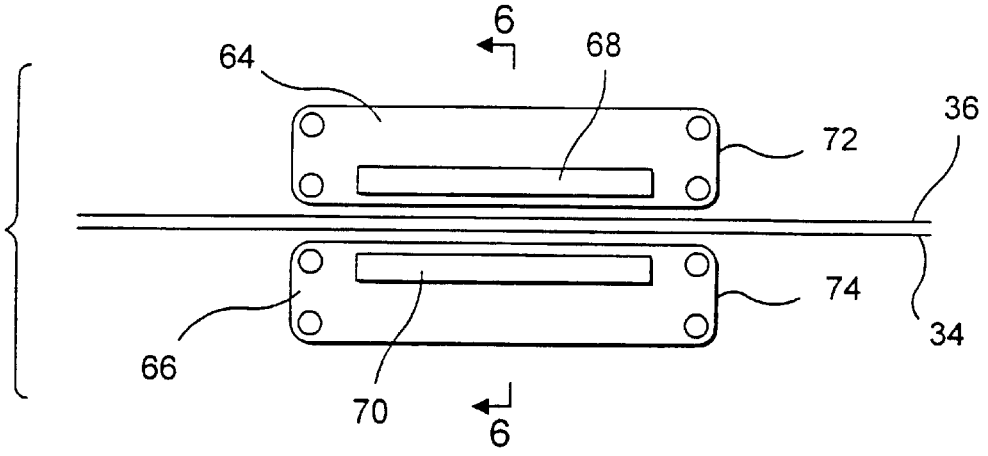
FIG. 5 is a cross-sectional view taken as indicated by line 5—5 in FIG. 1.
Figure 6:
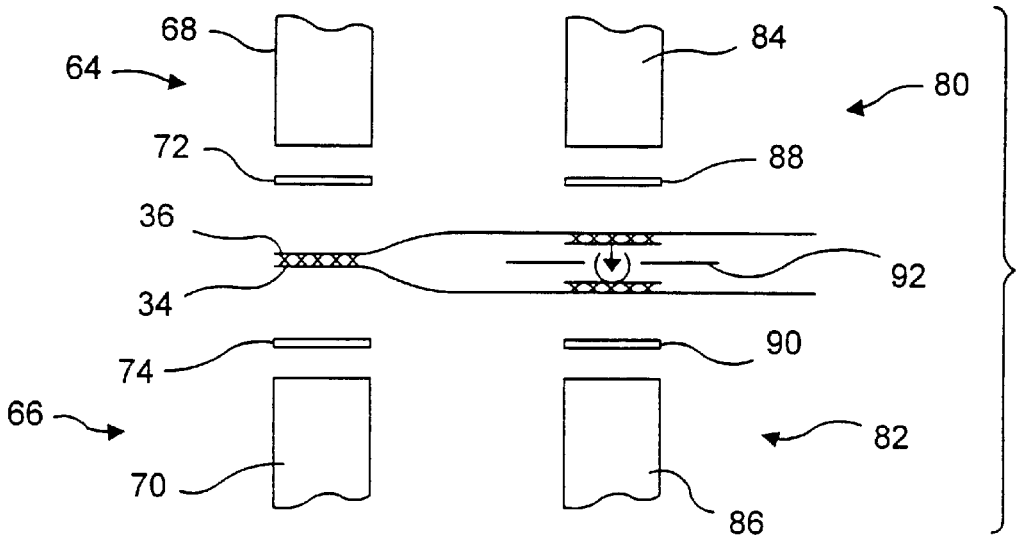
FIG. 6 is a cross-sectional view taken as indicated by line 6—6 in FIG. 5.

Downstream from the two edge sensing and control devices are an upper sealing section 60 and a lower sealing section 62. Both of the upper and lower sealing sections 60,62, as shown in FIGS. 5 and 6, include an edge sealing section and a zipper sealing section aligned in parallel with one another. The sealing sections may be of the type typically used in the prior art. For example, edge sealing sections 64,66 may include stationary heating bars 68,70 surrounded by belts 72,74, respectively, of Kapton- or Teflon-coated steel running with the film 12 passing through the edge sealing sections 64,66 to prevent the film from sticking to the stationary heating bars 68,70. Likewise, zipper sealing sections 80,82 may include stationary heating bars 84,86 surrounded by belts 88,90, respectively.

The upper and lower sealing sections 60,62 may also be provided with a suitable stationary device 92 to accurately guide and position the zipper 38 between the upper and lower zipper sealing sections 80,82.

Finally, further downstream from the upper sealing section 60 and the lower sealing section 62 on the horizontal FFS machine 10 are upper and lower side seal and cut-off jaws 94,96 which separate one package from the next in the usual manner.

Modifications to the above would be obvious to those of ordinary skill in the art, yet such modifications would not bring the invention so modified beyond the scope of the appended claims.

What is claimed is:

1. A horizontal form-fill-and-seal (FFS) machine for packaging consumer products, said horizontal FFS machine comprising:

means for providing a continuous length of packaging film having two lateral edges;

means for placing said consumer products to be packaged at intervals along one half of said continuous length of packaging film;

means for folding said continuous length of packaging film continuously down the center thereof and over upon said consumer products;

device for aligning said lateral edges of said folder continuous length of packaging film with one another said device including means for sensing each of said lateral edges and means for adjusting the position of said lateral edges with respect to one another;

means for feeding a zipper between said aligned lateral edges of said folded continuous length of packaging film proximal to said aligned lateral edges;

means for sealing said aligned lateral edges of said folded continuous length of packaging film to one another opposite to said film fold;

means for sealing said zipper to said folded continuous length of packaging film adjacent to said aligned edges;

means for sealing said folded continuous length of packaging film crosswise at intervals between said consumer products to create individual packages; and means for separating said individual packages from one another.

2. A horizontal FFS machine as claimed in claim 1 wherein said means for folding comprises:

a fold-forming member having a first fold-forming edge and a second fold-forming edge, said second fold-forming edge being oriented at an oblique angle relative to said first fold-forming edge and forming an apex therewith;

a wedge-shaped member aligned in the running direction of said continuous length of packaging film with said apex, said wedged-shaped member raising one half of said continuous length of packaging film for folding over upon said one half having said consumer products; and a folding guide, said folding guide being disposed at an oblique angle with respect to the running direction of said continuous length of packaging film and being adapted to fold said raised one half of said continuous length of packaging film continuously over upon said other half.

3. A horizontal FFS machine as claimed in claim 2 wherein said second fold-forming edge of said fold-forming member is oriented at an oblique angle between 15° and 30° relative to said first fold-forming edge.

4. A horizontal FFS machine as claimed in claim 1 wherein said means for feeding a zipper comprises a supply reel adapted to feed said zipper between said aligned lateral edges of said folded continuous length of packaging film from a side thereof.

5. A horizontal FFS machine as claimed in claim 1 herein said device for aligning said lateral edges of said folded continuous length of packaging film with one another includes an edge sensing and control device for each lateral edge, each of said edge sensing and control devices comprising a sensing device and a steerable guide wheel coupled therewith, said sensing device being adapted to detect said lateral edge and to signal said steerable guide wheel to correct the position of said lateral edge when said lateral edge is not in proper location.

6. A horizontal FFS machine as claimed in claim 5 wherein said device for aligning said lateral edges includes a photo-optical edge sensing device.

7. A horizontal FFS machine as claimed in claim 1 wherein said means for sealing said aligned lateral edges of said folded continuous length of packaging film to one another and said means for sealing said zipper to said folded continuous length of packaging film include a sealing section for each lateral edge, each of said sealing sections comprising a pair of parallel sealing devices, one of said sealing devices being adapted to seal said aligned lateral edges together and the other of said sealing devices being adapted to seal said zipper to said packaging film.

8. A horizontal FFS machine as claimed in claim 1 wherein said means for sealing said folded continuous length of packaging film crosswise to create individual packages and said means for separating said individual packages from one another are a pair of upper and lower side seal and cut-off jaws.

9. A method for packaging consumer products on a horizontal form-fill-and-seal machine comprising;

providing a continuous length of packaging film having two lateral edges;

placing said consumer products to be packaged at intervals along one half of said continuous length of packaging film;

folding said continuous length of packaging film continuously down the center thereof and over upon said consumer products;

sensing said lateral edges;

aligning said lateral edges of said folded continuous length of packaging film with one another;

feeding a zipper between said aligned lateral edges of said folded continuous length of packaging film, proximal to said aligned lateral edges;

sealing said aligned lateral edges of said folded continuous length of packaging film to one another;

sealing said zipper to said folded continuous length of packaging film, adjacent to said aligned edges;

sealing said folded continuous length of packaging film crosswise at intervals between said consumer products to create individual packages; and separating said individual packages from one another.

* * * * *